United States Patent [19]

Schimmel et al.

[11] 4,228,986

[45] Oct. 21, 1980

[54] ATTACHMENT FOR ANCHORING A SAFETY BELT

[75] Inventors: Vernon R. Schimmel; Joseph L. Foszcz, both of Chicago, Ill.

[73] Assignee: Symons Corporation, Des Plaines, Ill.

[21] Appl. No.: 19,922

[22] Filed: Mar. 12, 1979

[51] Int. Cl.[3] ..... E04G 11/06

[52] U.S. Cl. ..... 249/202; 249/191; 249/192; 249/205; 249/211; 249/219 R; 249/219 W

[58] Field of Search ..... 249/202, 191, 205, 211, 249/213, 218, 219 R, 219 W, 192

[56] References Cited

U.S. PATENT DOCUMENTS

| | | | |
|---|---|---|---|
| 3,661,354 | 5/1972 | Dagiel et al. | 249/192 |
| 3,754,729 | 8/1973 | Maynen | 249/192 |
| 4,030,694 | 6/1977 | Schimmel | 249/219 |

*Primary Examiner*—Donald J. Arnold
*Attorney, Agent, or Firm*—Gerlach & O'Brien

[57] ABSTRACT

An attachment for use in anchoring a safety belt on a vertically extending supporting member such as a frame member of a concrete wall form side includes a plate-like bracket member and a connecting member extending outwardly from one face of the bracket member. The bracket member is disposed on one side of the supporting member and projects outwardly beyond a vertical free edge thereof in use, while the connecting member is inserted through an opening in the supporting member, which may be an opening provided for other purposes in a frame member of a form side, for securing the attachment to the supporting member. An opening is provided in the projecting portion of the bracket member, and it serves to receive an element of a safety belt for connecting the belt to the bracket member. Ear portions extend outwardly from one face of the projecting portion at opposite lateral margins thereof, and they project over and adjacent to the free edge of the supporting member, in respective upper and lower positions, depending upon the side of the supporting member on which the bracket member is mounted. When a downward pulling force is exerted on a safety belt connected to the attachment, in turn secured to the supporting member, the lower one of the ear portions abuts on the free edge in torque load-resisting engagement therewith.

12 Claims, 5 Drawing Figures

ATTACHMENT FOR ANCHORING A SAFETY BELT

BACKGROUND OF THE INVENTION

This invention relates to an attachment for anchoring a safety belt on a vertically extending supporting member, more particularly, on a vertical frame member of a concrete wall form.

Concrete wall forms having steel frame members are in widespread use. In particular, a popular type of form is assembled with form sides each of which embodies a plurality of upstanding panels arranged in edge-to-edge relation, each panel embodying an inner facing from which there projects outwardly a marginal reinforcing frame including vertical and horizontal frame members. A form side may be constructed of a gang of such panels, which includes a plurality of horizontally adjacent panels having contiguous vertical frame members on respective panels, and also a plurality of vertically adjacent panels having contiguous horizontal frame members on respective panels. The resulting form has substantial length and height. Examples of such panels are the "Steel-Ply" panels manufactured by Symons Corporation of Des Plaines, Ill.

Although the practice is discouraged, individuals at times work on the forms at elevated levels, performing certain operations, such as breaking ties. In order to guard against injury due to falls, reliable and convenient safety equipment is needed. In particular, there is need for equipment which will enable a workman provided with a safety belt to securely and removably attach the belt to a form. To this end, an attachment for anchoring a safety belt to a form side has been provided previously, as disclosed in co-pending U.S. patent application Ser. No. 907,138, filed on May 18, 1978 and entitled "Safety Key and Locking Means Therefor For Use With Concrete Wall form Panels," which application was filed by Vernon R. Schimmel, one of the present inventors. The attachment of the application, termed a "safety key," is constructed with a shank portion having a slot therein, and an enlarged head portion having an opening therein. The slot is designed to receive a conventional wedge bolt, and the opening is designed to receive a safety belt element, particularly, a hook portion of a safety belt.

The reinforcing frame members of the aforesaid "Steel-Ply" panel are constructed with notched edges forming a series of vertically spaced closed notches defined by pairs of contiguous vertical frame members. The frame members also are provided with wedge bolt-receiving slots in their sides, which are arranged in vertically spaced pairs of opposed slots in the contiguous vertical frame members. The closed notches serve various purposes, including reception of the ends of tie rods inserted therethrough, the reception of members connecting walers and braces to the form, and others. The slots serve to receive conventional wedge bolts, which may be employed to draw adjacent panels tightly together, anchor tie rods on the frame, and/or cooperate with other members to be anchored, which extend through the notches. The slots are relatively abundant, and a number of slots dispersed around the form remain unused. On the other hand, the notches are provided in more limited numbers, and they and/or the slots adjacent thereto frequently are in use to a large extent, for the above-described purposes.

The safety key of the aforementioned Schimmel application is designed for insertion of its shank portion either in one of the closed notches formed between the outer edges of the frame member, or in one of the pairs of wedge bolt-receiving slots formed along the sides of the frame members, the notches and the slots being similar in size. The safety key is secured in place by a wedge bolt inserted through the slot in the shank portion of the safety key. However, there may be no notch available where it is desired to mount a safety key. The alternative insertion of a safety key in a pair of slots in the sides of the frame members is less desirable, inasmuch as the key is concealed from the workmen at times, and may be difficult to reach. Also, in this case, the flat surfaces of the safety key lie in horizontal planes, and the key is subject to distortion by bending or twisting under load.

SUMMARY OF THE INVENTION

The present invention provides an attachment for anchoring a safety belt on a supporting member such as the vertical frame member described hereinabove, which may be mounted in a slot on a side of the supporting member while extending outwardly beyond the free edge of the member, so as to be visible from any location on an erected structure, and easily accessible without obstruction. In particular, the attachment is constructed to utilize one of the wedge bolt-receiving slots in a conventional vertical frame member of a concrete form, having such slots at vertically spaced centers therealong.

The attachment of the invention includes a load-bearing and transmitting bracket or base member which, owing to external mounting thereof, may be constructed in a size or embodying dimensions providing required load-bearing capacities, reliably and without distortion of the bracket member under load. The attachment also includes a connecting member similar to a wedge bolt, which may be inserted in a wedge bolt-receiving slot to receive a load from the bracket member and transmit the load to a supporting member. The combination of the bracket member and the connecting member is such as to minimize any torque or bending moment on the connecting member, while maximizing load transmittal to the connecting member in shear.

In accordance with the invention, an attachment for use in anchoring a safety belt on a supporting member having a vertically extending side surface terminating in a vertically extending free edge on the member and also having an opening extending therethrough from the side surface, which attachment provides the foregoing and other advantages, comprises a bracket member having integral body, head, and ear portions, the body and head portions adjoining each other at end margins thereof and the ear portions extending outwardly from one face of the head portion at opposite lateral margins thereof, the head portion having an opening extending therethrough from the said one face thereof adapted to receive an element of a safety belt for connecting the belt to the bracket member, and a connecting member extending outwardly from one face of the body portion and insertable through the opening in the supporting member for connecting the attachment thereto, the body portion being disposed with the said one face thereof adjacent to the side surface of the supporting member while the head portion and its opening extend outwardly beyond the edge of the supporting member, and the ear portions project over and adjacent to the edge in respective upper and lower positions, when the attachment is secured to the supporting member, the lower one of the ear portions abutting on the edge in torque load-resisting engagement therewith when a downward pulling force is exerted on a safety belt connected to the attachment.

A preferred embodiment of the attachment has the additional advantage that its connecting member is permanently affixed to the bracket member, so that the attachment may be attached to and removed from a supporting member rapidly, and there are less parts to keep track of on the job as well as in inventory.

BRIEF DESCRIPTION OF THE DRAWINGS

The drawings illustrate a preferred embodiment of the invention, without limitation thereto. In the drawings, like parts are identified by like reference symbols in each of the views, and.

DESCRIPTION OF THE PREFERRED EMBODIMENT

Figure 1:
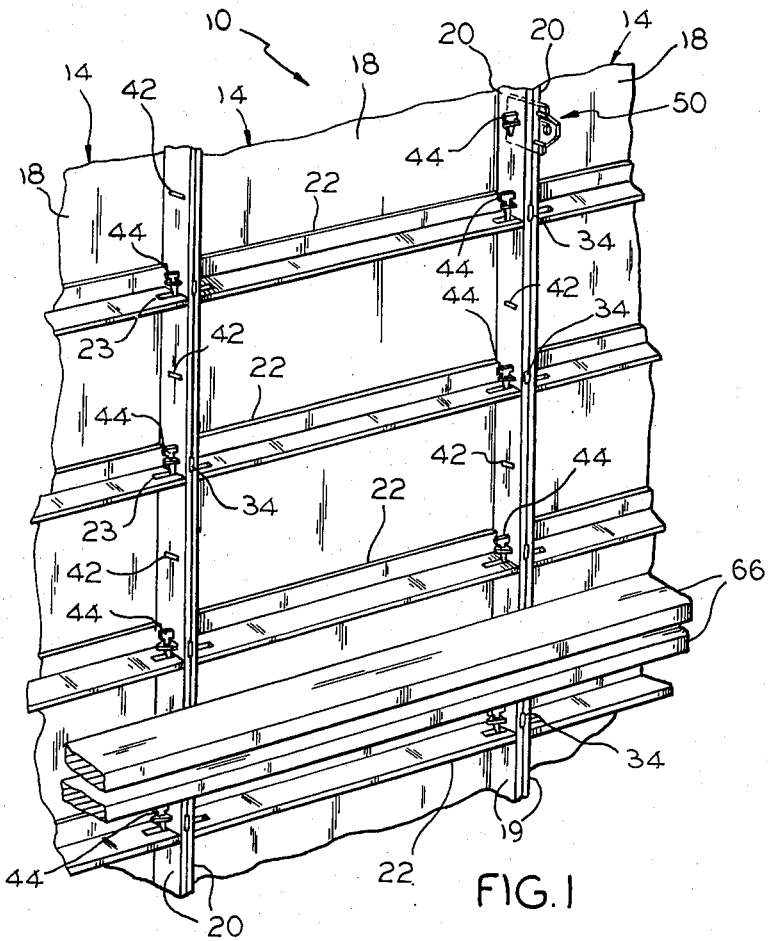
FIG. 1 is a fragmentary outside perspective view of a portion of one side of a concrete wall form utilizing "Steel-Ply" panels, illustrating a preferred embodiment of an attachment in accordance with the invention secured to the form side in operative position.

Referring to FIG. 1 of the drawings, a fragmentary portion of a conventional composite concrete wall form side 10 of the "Steel-Ply" panel type is illustrated. The form side 10 is opposed by a similar wall form side, not illustrated, and the two sides are connected together and held in spaced apart relationship in a conventional manner, by a series of horizontally extending tie rods, also not illustrated.

Each form side 10 is made up of a gang or group of conventional rectangular form panels 14, which are arranged in upstanding edge-to-edge relationship. Although not shown, additional panels 14 may be mounted on top of and/or below those illustrated, and all of the panels may be secured together in a single gang constituting the form side. Each panel includes a rectangular plywood facing 18 secured to a marginal rectangular steel reinforcing frame 19, which extends outwardly from the outer face of the facing in perpendicular relation thereto. The frame 19 includes vertical and horizontal frame members, only the vertical frame members 20 of which are illustrated. The sides of the facing 18 are bounded by two parallel vertical frame members 20. The frame 19 also includes a series of vertically spaced apart horizontal crossbars 22, in the form of angle bars having bolt-clearance notches 23 in one flange at their opposite ends. The crossbars 22 extend across the outer surface of the facing 18, and their ends are secured, as by welding, to the vertical frame members 20. The illustrated panels 14 are two feet wide and from three to eight feet long.

Figure 4:
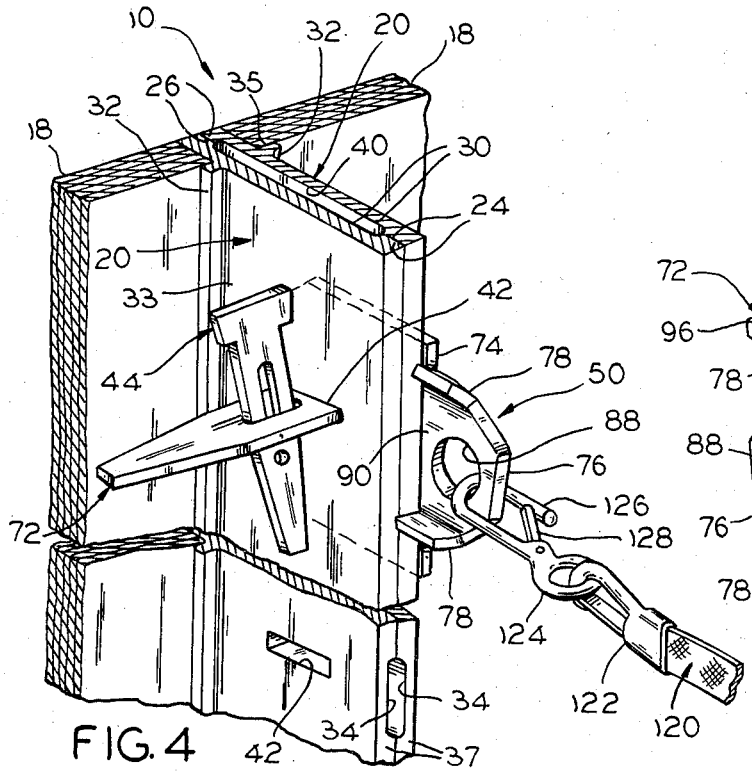
FIG. 4 is a similarly enlarged fragmentary perspective view of the attachment as secured to the form, corresponding to the small view thereof in FIG. 1.
Figure 5:
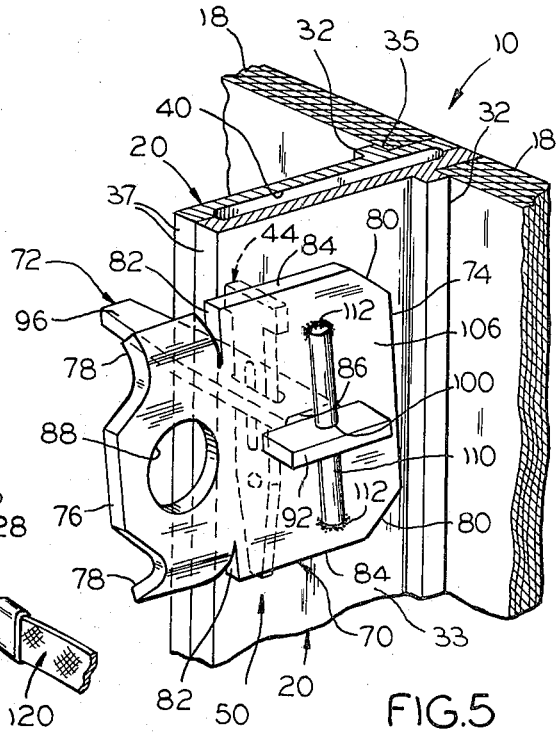
FIG. 5 is a further enlarged fragmentary perspective view of the attachment secured to the form as in FIGS. 1 and 4, the view being taken from the opposite side of vertical frame members on which the attachment is mounted.

The vertical frame members 20, and similarly the horizontal frame members, are structural steel members each having a generally shallow U-shaped cross section, as seen in FIGS. 4 and 5. Each frame member 20 includes on one side thereof spaced outer and inner, longitudinally extending, parallel marginal ribs 24 and 26, respectively. A flat web portion 30 extends between the ribs. A rib-like longitudinally extending shoulder 32 projects outwardly from a vertically extending external side surface 33 of each frame member 20, on the side opposite to the side having the ribs. The shoulder 32 provides a seat 35 for a vertically extending edge of a facing 18.

At intervals along the vertical frame members 20, edge notches 34 (termed "dado" notches) are formed in the outer ribs 24, and corresponding aligned notches, not shown, are formed in the inner ribs 26. When two panels 14 are assembled in edge-to-edge relation, two vertical frame members 20 are placed in contiguity, and edge notches 34 along the respective frame members are disposed in pairs of opposed notches, thereby forming closed notches or openings through the adjoining ribs 24 at the outer free edges 37 on the frame members. Like closed notches or openings, not illustrated, extend through the adjoining inner ribs 26 at the inner edges of the frame members 20. The openings formed by the notches provide for the entry of the ends of tie rods into a narrow chamber 40 formed between adjacent web portions 30, for securing the tie rods to the form side in a conventional manner. The notches 34 also are used for other purposes, such as the insertion into the chamber 40 of connecting members for walers and braces, as described hereinabove. The notches 34 have a length of approximately $\frac{3}{4}$ inch or slightly greater, and, in general, are provided at intervals of one foot. Additional notches 34 may be provided in the outer ribs 24, near the top and bottom of each panel 14, so that the notch interval in these areas is six inches. Tie rods are provided at vertical spacings of one foot and two feet. The foregoing and subsequent identifications of dimensions have particular reference to the "Steel-Ply" panels and their use.

Each of the vertical frame members 20 is provided with a vertical series of horizontally extending wedge bolt-receiving slots or openings 42, which extend through the web portions 30. A slot 42 is aligned with the center of each of the notches 34 in each frame member, and additional slots 42 are provided. The slots 42 are formed at six-inch intervals in the illustrative structure, and they are approximately $\frac{3}{4}$ inch long. The slots 42 are designed particularly for receiving conventional wedge bolts 44, each in turn receiving another wedge bolt 44, for the purpose of drawing adjacent frame members 20 tightly together, as illustrated in FIG. 1. In certain instances, the wedge bolts 44 also serve to connect to the frame members 20 tie rods or connecting members which are inserted through the edge notches into the chamber 40.

Figure 2:
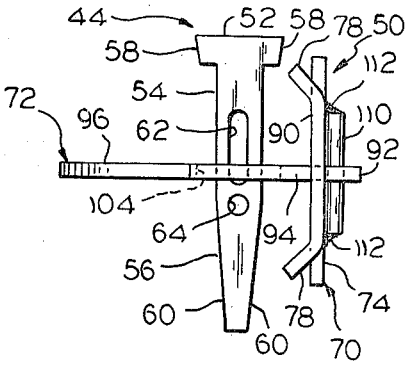
FIGS. 2 and 3 are, respectively, enlarged end elevational and top plan views of the attachment and a wedge bolt employed therewith.
Figure 3:
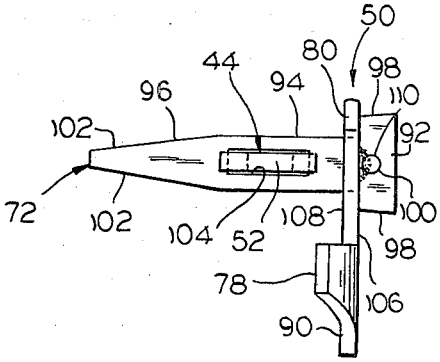

Referring to FIGS. 2 and 3, in which a wedge bolt 44 is employed in combination with an attachment 50 in accordance with the invention, as subsequently described, the wedge bolt 44 is an integral one-piece structure which includes, successively, a quadrilateral head portion 52, a rectangular body portion 54, and a tapered wedge portion 56. The head portion 52 is enlarged with respect to the body portion 54, and has two opposed oblique side edges 58 which converge in the direction of the body portion. The wedge portion 56 has two opposed oblique side edges 60 which converge outwardly from the body portion 54, at an angle of convergence approximating the angle of convergence of the side edges 58 of the head portion, and which are approximately coplanar with respective ones of the latter edges. An elongated wedging slot 62 extends longitudinally in the body portion 54, and it is dimensioned to receive the body portion 54 of a second wedge bolt 44 in wedging engagement therein. In the illustrative structure, the wedging slot 62 is about one inch long, and the body portion is about 23/32 inch wide. A circular utility hole 64 is provided in the wedge portion 56 at its inner end.

In securing two panels 14 together, the wedge portion 56 of a first wedge bolt 44 is inserted through a pair of opposed wedge bolt-receiving slots 42 in two contiguous frame members 20, until the head portion 52 abuts on one frame member 20 and the wedge portion and part of the wedging slot 62 in the body portion 54 project beyond the external side surface 33 of the second frame member 20. The wedge portion 56 of a second wedge bolt 44 is inserted through the wedging slot 62 of the first bolt, and the second bolt is hammered into the first bolt. The side edges 58 and 60 on one side of the second bolt slide on the surface 33 of the second frame member, and the second bolt exerts a wedging action on the first bolt, until the resulting panel assembly, illustrated in FIG. 1, is tight.

Two walers 66 extend across the outside of the form side 10, in the structure illustrated in FIG. 1. The walers may be secured to the form side 10 by any of the various clamping devices. Such devices may utilize certain of the edge notches 34 in the outer ribs 24 of the vertical frame members 20 and be connected by means of wedge bolts 44, assembled in the foregoing manner. The walers 66 serve to align the panels 14 and rigidify the form side 10.

Referring to FIGS. 2–5, the attachment 50 for anchoring a safety belt is constructed of a plate-like bracket or base member 70 and a flat, wedge bolt-like connecting member 72, which are separate parts in the illustrative embodiment. The bracket member 70 has integral body, head, and ear portions 74, 76, and 78, respectively. The body portion 74 is a generally rectangular flat plate, which may be beveled, as indicated at 80, or rounded at inner corner locations, for clearance purposes. Similarly, the head portion 76 is a smaller, generally rectangular flat plate, which is integral and coplanar with the body portion 74. The body and head portions 74 and 76 adjoin each other at their inner end margins, between the inner ends of transverse cuts 82 in opposite lateral margins 84 of the bracket member 70. A longitudinally extending elongated assembly slot 86 is provided in the body portion 74, centrally between the lateral margins 84, and a circular belt-receiving opening or hole 88 is provided in the head portion 76, centrally between its opposite lateral margins.

The ear portions 78 are bent from the plane of the body and head portions 74 and 76, so that they extend outwardly from an inner face 90 of the head portion 76 at the opposite lateral margins thereof. The ear portions 78 extend obliquely from the head portion 76, at an angle of about 50–60 degrees to the inner face 90 thereof, for a distance about equal to the width or thickness of an outer free edge 37 on a vertical frame member 20.

The connecting member 72 in the illustrative embodiment is like the wedge bolt 44, except for the disposition of the openings in the two. Referring particularly to FIG. 3, the connecting member 72 includes an enlarged quadrilateral head portion 92, a rectangular body portion 94, and a tapered wedge portion 96, having the same sizes and shapes as the head portion 52, the body portion 54, and the wedge portion 56, respectively, of the wedge bolt 44. The head portion 92 of the connecting member 72 has inwardly converging oblique side edges 98 and a circular mounting hole 100 disposed centrally between the side edges. The wedge portion 96 has outwardly converging oblique side edges 102, having about the same angle of convergence as the side edges 98 of the head portion and being approximately coplanar with respective ones of such side edges. A longitudinally extending elongated wedging slot 104 is formed in the body portion 94, centrally between its side edges and adjacent to the wedge portion 96.

The wedging slot 104 in the connecting member 72, like the wedging slot 62 in the wedge bolt 44, is about one inch long in the illustrative embodiment, for receiving the body portion 54 of a wedge bolt in wedging engagement therein. The width of the body portion 94 of the connecting member, about 23/32 inch in the illustrative structure, is slightly less than the width of a wedge bolt-receiving slot 42 in a frame member 20, for insertion of the connecting member and relatively close reception thereof in the slot. The assembly slot 86 in the body portion 74 of the bracket member 70 has about the same size and shape as the wedge bolt-receiving slot 42, for mounting the body portion 94 of the connecting member therein.

The connecting member 72 is assembled with the bracket member 70 in the attachment 50, with the body portion 94 of the connecting member 72 received in the assembly slot 86 in the body portion 74 of the bracket member, and with the head portion 92 of the connecting member abutting on the outer face 106 of the latter body portion. The wedge portion 96 and a major part of the body portion 94 of the connecting member extend outwardly from the inner face 108 of the bracket member body portion 74. A short cylindrical rod length 110 is inserted through the mounting hole 100 in the head portion 92 of the connecting member, and its ends are joined by welds 112 to the outer face 106 of the bracket member body portion 74. In this manner, the bracket member 70 and the connecting member 72 are permanently secured together in a unitary attachment 50.

The attachment 50 is mounted on the form side 10 for use in anchoring a safety belt 120 (FIG. 4) or the like thereon. The attachment 50 is mounted in a pair of wedge bolt-receiving slots 42 in two contiguous vertical frame members 20. The connecting member 72 is inserted through the slots 42 from the external side surface 33 on either of the contiguous frame members 20, and the connecting member and part of its wedging slot 104 project from the external side surface 33 on the other frame member. At this time, the body portion 74 of the bracket member is disposed with its inner face 108 adjacent to the former side surface, while the head portion 76 and its belt-receiving opening 88 extend outwardly beyond the outer free edges 37 of the frame members 20, and the ear portions 78 project over and adjacent to the outer edge 37 at which the former side surface terminates, in respective upper and lower positions as illustrated in FIGS. 4 and 5.

A wedge bolt 44 is inserted into the connecting member wedging slot 104 from the top of the member, and it is driven into the slot, as by hammering. The side edges 58 and 60 on one side of the bolt slide on the external side surface 33 of the adjacent frame member 20. The edge of the body portion 54 on the opposite side to the sliding edges 58 and 60 exerts a wedging action on the connecting member 72, which pulls the frame members 20 together between the bracket member 70 and the wedge bolt 44. The attachment 50 and the wedge bolt 44 cooperate in this manner to secure the attachment to the frame members 20 and also to hold the frame members tightly together, in the same manner as when two wedge bolts 44 are used for this purpose. The attachment 50 may be removed simply by driving the wedge bolt 44 in the opposite direction and out of the connecting member slot 104, and withdrawing the latter from the wedge bolt-receiving slots 42.

Attachments 50 may be secured to the form side 10 and to another form side which completes the form, either prior to or during erection of the form sides. For example, a form gang may be laid out at ground level and the attachments disposed about the gang at locations selected to provide conveniently accessible attachment points for a safety belt 120, wherever a workman may be working on the raised form and requires protection from falling. The attachments may be mounted on five to seven foot centers, for example, vertically and horizontally. Alternatively, the panels 14 may be joined together as the form side 10 is erected, and the attachments may be mounted at this time or subsequently. The attachments may be mounted by persons working on the form side 10 subsequent to the erection of the form, as and where needed.

The attachment 50 essentially is symmetrical about its longitudinal axis, so that either of the ear portions 78 may be the uper portion and the remaining ear portion the lower portion. This structure enables the attachment to be mounted on either of the external side surfaces 33 of a pair of contiguous vertical frame members 20, as may be most convenient or otherwise desirable. In each case, the head portion 76 and the belt-receiving opening 88 therein are in projecting positions, clearly visible and readily accessible for attaching the safety belt 120. While the attachment will be mounted on vertical frame members 20 most frequently, it may, alternatively, be mounted similarly on other supporting members, for example, on slotted angle bars forming so-called outside corners on concrete forms.

The illustrative safety belt 120 is of a conventional type, and it terminates in a snap hook 122 connected to a safety hook 124. The safety hook 124 includes a hook proper 126 and a spring-pressed pivoted guard 128. A workman need only reach out the safety hook 124 to the attachment 50, and insert the hook proper 126 through the belt-receiving opening 88 in the bracket member 70, to fasten the belt 120, in the manner illustrated in FIG. 4.

Should the workman fall, and thereby place a heavy load on the safety belt 120, which is transmitted to the attachment 50, the first action will be a slight rotation of the bracket member 70 as a downward and outward pulling force is exerted thereon, to bring the lower one of the ear portions 78 into abutting engagement with the outer free edge 37 of the adjacent vertical frame member 20. Thereupon, the torque load applied to the head portion 76 of the bracket member 70 is resisted by the latter edge 37. The connecting member 72 has sufficient freedom of rotation in the wedge bolt-receiving slots 42 to rotate with the bracket member 70, so that no significant torque is applied to the connecting member. The slight rotation of the attachment 50 in this manner results from a small spacing of the ear portions 78 from the adjacent free edge 37, which accommodates manufacturing variances or tolerances. Such spacing in the illustrative embodiment may be, for example, 1/32 inch.

With the lower ear portion 78 in engagement with the frame member edge 37, the load on the connecting member 72, as load forces are applied to it while held captive in the wedge bolt-receiving slots 42, essentially is a shear load, which the connecting member 72 is well able to withstand. By virtue of the fact that the bracket member 70 is an outside member, its dimensions may be selected to provide strength ample to withstand and transmit any load which might be encountered. For the foregoing reasons, the attachment 50 may make use of the relatively small wedge bolt-receiving slots 42 for connecting purposes, with ample load resistance and with no distortion of its members under load.

While the attachment 50 is constructed of separate bracket and connecting members 70 and 72, it might also be formed integrally in one piece. It is preferred, however, to construct the attachment 50 from the principal bracket and connecting members 70 and 72, for ease and economy of construction while providing the required physical characteristics. Each of the members 70 and 72 may be cold-formed from sheet steel, by stamping and punching The rod length 110 and the welding thereof to the bracket member 70 may be dispensed with, if desired, so that the bracket member 70 and the connecting member 72 are loose parts, which are assembled together when used. The illustrative structure is preferred, however, inasmuch as the welded rod length serves to keep the members together and reduce the number of loose parts which must be carried and inventoried. In this connection, the wedging slot 104 in the connecting member is displaced towards the wedge portion 96, as compared to the wedging slot 62 in the wedge bolt 44, thereby to accommodate the thickness of the bracket member body portion 74. The wedge bolt 44 and the connecting member 72 might be confused with each other if the connecting member is employed as a separate part. The welded rod length 110 also provides a more rigid attachment, inasmuch as it minimizes the amount of play of the connecting member 72 in the assembly slot 86.

While a preferred embodiment of the invention has been described and illustrated, and reference has been made to changes and modifications which may be made therein, it will be apparent to those skilled in the art that various other changes and modifications may be made within the spirit and scope of the invention. It is intended that all such changes and modifications be included within the scope of the appended claims.

We claim:

1. An attachment for use in anchoring a safety belt on a supporting member having a vertically extending side surface terminating at a vertically extending free edge on the member, and also having an opening extending therethrough from the side surface, said attachment comprising:

a bracket member having integral body, head, and ear portions, said body and head portions adjoining each other at end margins thereof and said ear portions extending outwardly from one face of said head portion at opposite lateral margins thereof, said head portion having an opening extending through it from said one face and sized to receive a hook portion of a workman's safety belt therethrough for connecting the belt to the bracket member, and a connecting member extending outwardly from one face of said body portion and insertable through said opening in the supporting member for connecting the attachment thereto, said body portion being disposed with said one face thereof adjacent to said side surface of the supporting member while said head portion and its opening extend outwardly beyond said edge, and said ear portions project over and adjacent to said edge in respective upper and lower positions, when the attachment is connected to the supporting member, the lower one of said ear portions abutting on said edge in torque load-resisting engagement therewith when a downward pulling force is exerted on a safety belt connected to the attachment.

2. An attachment as defined in claim 1 and wherein said connecting member is permanently affixed to said bracket member.

3. An attachment as defined in claim 2 and wherein said bracket member is a plate-like structure.

4. An attachment as defined in claim 3 and including means forming a wedging slot in said connecting member adapted to receive a wedge bolt for removably securing the attachment to the supporting member.

5. An attachment as defined in claim 1 and including means forming a wedging slot in said connecting member adapted to receive a wedge bolt for removably securing the attachment to the supporting member.

6. An attachment as defined in claim 1 and wherein said opening in the supporting member is a wedge bolt-receiving slot, and said connecting member is constructed in the form of a wedge bolt.

7. An attachment for use in anchoring a safety belt on a concrete wall form side of the type that embodies a plurality of upstanding panels arranged in edge-to-edge relation, each panel embodying an inner facing from which there projects outwardly a marginal reinforcing frame including vertical frame members having vertically extending side surfaces terminating at vertically extending outer free edges on the frame members, the vertical frame members of adjacent panels being arranged in contiguity and having formed therein at spaced centers theralong pairs of opposed wedge bolt-receiving slots extending through the members from their side surfaces, said attachment comprising:

a plate-like bracket member having integral body, head, and ear portions, said body and head portions adjoining each other at end margins thereof and said ear portions extending outwardly from one face of said head portion at opposite lateral margins thereof, said head portion having an opening extending through it from said one face and sized to receive a hook portion of a workman's safety belt therethrough for connecting the belt to the bracket member, and a connecting member extending outwardly from one face of said body portion and insertable through one of said pairs of wedge bolt-receiving slots in two contiguous vertical frame members from the external side surface on a selected one of the frame members to project from the external side surface on the other frame member, said connecting member having a wedging slot formed in the projecting portion thereof adapted to receive a wedge bolt for removably securing the attachment to the latter frame members, said body portion being disposed with said one face thereof adjacent to the first-named external side surface while said head portion and its opening extend outwardly beyond said edges of the latter frame members, and said ear portions project over and adjacent to the edge at which the first-named external side surface terminates in respective upper and lower positions, when the attachment is secured to the frame members, the lower one of said ear portions abutting on the latter edge in torque load-resisting engagement therewith when a downward pulling force is exerted on a safety belt connected to the attachment.

8. An attachment as defined in claim 7 and wherein said connecting member is permanently affixed to said bracket member.

9. In combination with a concrete wall form side of the type that embodies a plurality of upstanding panels arranged in edge-to-edge relation, each panel embodying an inner facing from which there projects outwardly a marginal reinforcing frame including vertical frame members having vertically extending side surfaces terminating at vertically extending outer free edges on the frame members, the vertical frame members of adjacent panels being arranged in contiguity and having formed therein at spaced centers therealong pairs of opposed wedge bolt-receiving slots extending through the members from the side surfaces, an improved attachment for anchoring a safety belt on the form side, which comprises:

a bracket member having integral body, head, and ear portions, said body and head portions adjoining each other at end margins thereof and said ear portions extending outwardly from one face of said head portion at opposite lateral margins thereof, said head portion having an opening extending through it from said one face and sized to receive a hook portion of a workman's safety belt therethrough for connecting the belt to the bracket member, and a connecting member extending outwardly from one face of said body portion and insertable through one of said pairs of wedge bolt-receiving slots in two contiguous vertical frame members from the external side surface on a selected one of the frame members for connecting the attachment to the frame members, said body portion being disposed with said one face thereof adjacent to said external side surface while said head portion and its opening extend outwardly beyond said edges of the latter frame members, and said ear portions project over and adjacent to the edge at which the external side surface terminates in respective upper and lower positions, when the attachment is secured to the frame members, the lower one of said ear portions abutting on the latter edge in torque load-resisting engagement therewith when a downward pulling force is exerted on a safety belt connected to the attachment.

10. A combination as defined in claim 9 and wherein said connecting member is permanently affixed to said bracket member.

11. A combination as defined in claim 10 and wherein said connecting member is insertable through said one pair of slots to project from the external side surface on the remaining one of the latter frame members, and said connecting member has a wedging slot formed in the projecting portion thereof adapted to receive a wedge bolt for removably securing the attachment to the frame members.

12. A combination as defined in claim 11 and wherein said bracket member is a plate-like structure.

* * * * *